US010401059B2

(12) United States Patent
Kim et al.

(10) Patent No.: US 10,401,059 B2
(45) Date of Patent: Sep. 3, 2019

(54) AIR CONDITIONER

(71) Applicant: LG ELECTRONICS INC., Seoul (KR)

(72) Inventors: Donghwi Kim, Seoul (KR); Junseong Park, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 289 days.

(21) Appl. No.: 15/408,228

(22) Filed: Jan. 17, 2017

(65) Prior Publication Data

US 2017/0205122 A1 Jul. 20, 2017

(30) Foreign Application Priority Data

Jan. 18, 2016 (KR) ..... 10-2016-0006092

(51) Int. Cl.

| | |
|---|---|
| ***F25B 13/00*** | (2006.01) |
| ***F25B 40/02*** | (2006.01) |
| ***F25B 41/04*** | (2006.01) |
| ***F25B 49/02*** | (2006.01) |
| ***F25B 41/00*** | (2006.01) |

(52) U.S. Cl.

CPC ..... *F25B 13/00* (2013.01); *F25B 40/02* (2013.01); *F25B 41/003* (2013.01); *F25B 41/046* (2013.01); *F25B 49/02* (2013.01); *F25B 2313/005* (2013.01); *F25B 2313/006* (2013.01); *F25B 2313/0233* (2013.01); *F25B 2313/02731* (2013.01); *F25B 2400/054* (2013.01); *F25B 2400/13* (2013.01); *F25B 2400/23* (2013.01);

(Continued)

(58) Field of Classification Search

CPC .. F25B 41/003; F25B 40/02; F25B 2313/006; F25B 2600/2519; F25B 2600/2509; F25B 2313/005; F25B 2400/23; F25B 2400/13; F25B 2400/054; F25B 2313/02731; F25B 2313/0233

See application file for complete search history.

(56) References Cited

U.S. PATENT DOCUMENTS

| | | | | |
|---|---|---|---|---|
| 8,020,393 | B2 | 9/2011 | Okada et al. | |
| 2010/0212342 | A1 * | 8/2010 | Jeong | F25B 41/00 62/208 |

(Continued)

FOREIGN PATENT DOCUMENTS

| | | |
|---|---|---|
| CN | 104110735 A | 10/2014 |
| EP | 0 915 306 A2 | 5/1999 |

(Continued)

*Primary Examiner* — Larry L Furdge

(74) *Attorney, Agent, or Firm* — Dentons US LLP

(57) ABSTRACT

An air conditioner including a compressor, an outdoor heat exchanger, an indoor heat exchanger, a switching valve for guiding refrigerant discharged from the compressor to the outdoor heat exchanger during a cooling operation and to the indoor heat exchanger during a heating operation, and an injection module for injecting a portion of the refrigerant discharged from the indoor heat exchanger to the compressor, performing heat exchange between a portion of the refrigerant discharged from the indoor heat exchanger and the refrigerant that moves from the outdoor heat exchanger to the indoor heat exchanger during the cooling operation, and injecting the refrigerant into the compressor.

20 Claims, 7 Drawing Sheets

(52) U.S. Cl.
CPC ..... *F25B 2600/2509* (2013.01); *F25B 2600/2519* (2013.01)

(56) References Cited

U.S. PATENT DOCUMENTS

| | | | | |
|---|---|---|---|---|
| 2013/0104580 | A1* | 5/2013 | Choi | F25B 1/10 62/115 |
| 2015/0020535 | A1 | 1/2015 | Hatomura et al. | |
| 2015/0362235 | A1* | 12/2015 | Yamashita | F25B 1/10 62/196.1 |

FOREIGN PATENT DOCUMENTS

| | | | |
|---|---|---|---|
| EP | 2 863 147 | A1 | 4/2015 |
| GB | 2 037 965 | A | 7/1980 |
| JP | 2011-202939 | A | 10/2011 |
| KR | 10-2005-0074066 | A | 7/2005 |
| KR | 10-2015-0078933 | A | 7/2015 |

* cited by examiner

AIR CONDITIONER

CROSS-REFERENCE TO RELATED APPLICATION

This application claims the priority benefit of Korean Patent Application No. 10-2016-0006092, filed on Jan. 18, 2016, in the Korean Intellectual Property Office, the disclosure of which is incorporated herein by reference.

BACKGROUND OF THE INVENTION

Generally, an air conditioner is an apparatus that cools or heats a room using a refrigeration cycle, which includes a compressor, an outdoor heat exchanger, an expansion valve, and an indoor heat exchanger. The air conditioner may be configured as a cooler to cool a room, a heater to heat a room, or a combined cooling/heating air conditioner, which selectively cools or heats a room.

The combined cooling/heating air conditioner generally includes a 4-way valve, which changes the path of refrigerant, compressed in the compressor, based on a cooling operation and a heating operation. During a cooling operation, the refrigerant, compressed in the compressor, flows to the outdoor heat exchanger by passing through the 4-way valve, and the outdoor heat exchanger serves as a condenser. Then, the refrigerant, condensed in the outdoor heat exchanger, is expanded in the expansion valve, and thereafter introduced into the indoor heat exchanger. At this time, the indoor heat exchanger serves as an evaporator, and in turn, the refrigerant evaporated in the indoor heat exchanger again passes through the 4-way valve to be introduced into the compressor.

During the cooling operation or the heating operation, refrigerant in the compressor may improve the coefficient of performance of a system.

However, the conventional technology of injecting the refrigerant into the compressor during the cooling operation includes bypassing a portion of the high-temperature and high-pressure liquid-phase refrigerant, having passed through the condenser, thus causing deterioration in the cooling ability of an indoor unit due to a reduction in the evaporation flow rate of the refrigerant.

SUMMARY OF THE INVENTION

In view of the foregoing, in accordance with one embodiment of the present invention, there is provided an air conditioner including a compressor for compressing refrigerant, an outdoor heat exchanger installed in an outdoor space for performing heat exchange between the refrigerant and outdoor air, an indoor heat exchanger installed in an indoor space for performing heat exchange between the refrigerant and indoor air, a switching valve for guiding the refrigerant, discharged from the compressor, to the outdoor heat exchanger during a cooling operation and to the indoor heat exchanger during a heating operation, and an injection module for injecting a portion of the refrigerant, discharged from the indoor heat exchanger, to the compressor, wherein the injection module performs heat exchange between the portion of the refrigerant discharged from the indoor heat exchanger and refrigerant, which moves from the outdoor heat exchanger to the indoor heat exchanger, during the cooling operation, and injects the heat-exchanged refrigerant into the compressor, thus increasing efficiency.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
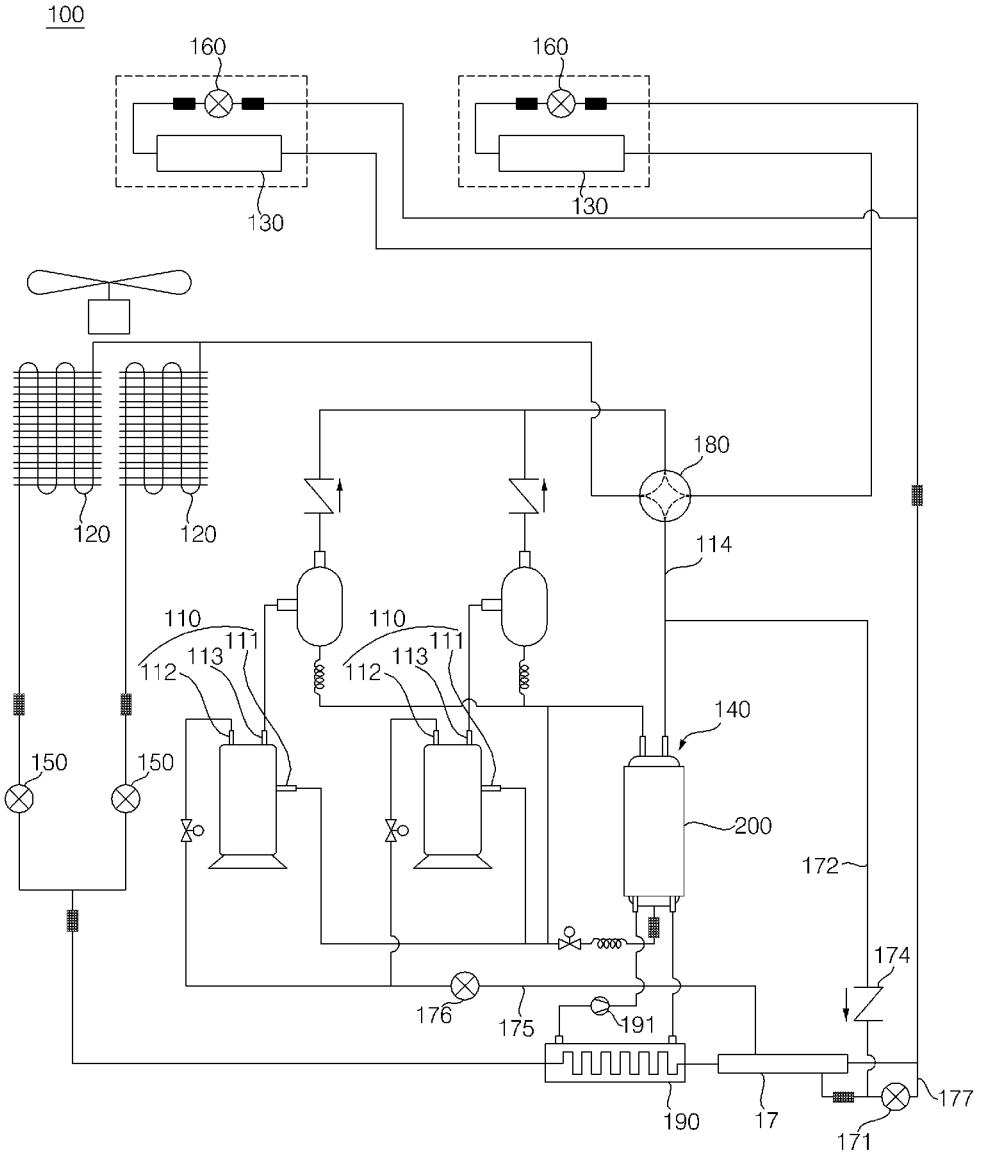
FIG. 1 is a schematic circuit diagram illustrating the refrigerant cycle of an air conditioner in accordance with one embodiment of the present invention.

Advantages and features of the present invention and methods for achieving those of the present invention will become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope of the present invention. The same reference numerals may refer to the same elements throughout the specification.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Hereinafter, exemplary embodiments of the present invention will be described with reference to the accompanying drawings.

Figure 2:
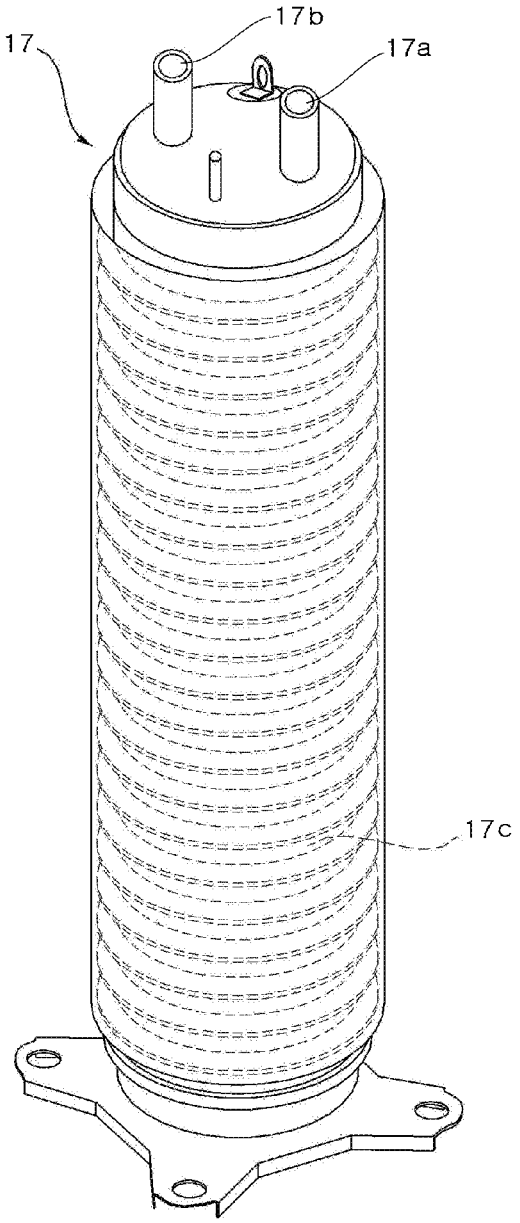
FIG. 2 is a view illustrating an injection heat exchanger of the air conditioner in accordance with one embodiment of the present invention.

FIG. 1 is a schematic circuit diagram illustrating the refrigerant cycle of an air conditioner in accordance with one embodiment of the present invention. FIG. 2 is a view illustrating an injection heat exchanger of the air conditioner in accordance with one embodiment of the present invention.

Referring to FIGS. 1 and 2, the air conditioner 100 may include a compressor 110 for compressing refrigerant, an outdoor heat exchanger 120 installed in an outdoor space for performing heat exchange between the refrigerant and outdoor air, an indoor heat exchanger 130 installed in an indoor space for performing heat exchange between the refrigerant and indoor air, a switching valve 180 for guiding the refrigerant discharged from the compressor 110 to the outdoor heat exchanger 120 during a cooling operation and to the indoor heat exchanger 130 during a heating operation, and an injection module for injecting a portion of the refrigerant discharged from the indoor heat exchanger 130 to the compressor 110.

The air conditioner 100 may further include a gas-liquid separator 140 for separating the refrigerant into liquid-phase refrigerant and gas-phase refrigerant.

The air conditioner 100 may include an outdoor unit and an indoor unit that are connected to each other. The outdoor unit may be installed in an outdoor space and the indoor unit installed in an indoor space.

The outdoor unit may include the compressor 110, the outdoor heat exchanger 120, an outdoor expansion valve 150, the injection module, and the gas-liquid separator 140.

The indoor unit may include the indoor heat exchanger 130 and an indoor expansion valve 160.

The compressor 110 may be installed in the outdoor unit, and compress low-temperature and low-pressure refrigerant that is introduced into high-temperature and high-pressure refrigerant.

The compressor 110 may have any of a variety of configurations. For example, the compressor 110 may include a reciprocation compressor using a cylinder and a piston, a scroll compressor using a pivotable scroll and a fixed scroll, or an inverter compressor for adjusting the compression of refrigerant based on an operational frequency.

One compressor 110 or a plurality of compressors 110 may be provided in some embodiments. In the present embodiment, two compressors 110 are provided.

The compressor 110 is connected to the switching valve 180, the gas-liquid separator 140, and the injection module. The compressor 110 may include an inlet port 111, into which refrigerant evaporated in the indoor heat exchanger 130 is introduced during a cooling operation, or into which refrigerant evaporated in the outdoor heat exchanger 120 is introduced during a heating operation, an injection port 112, into which relatively low pressure refrigerant, evaporated in the injection module via heat exchange, is injected, and an outlet port 113, from which the compressed refrigerant is discharged.

For example, as shown, the compressor 110 includes the inlet port 111 into which the refrigerant evaporated in the evaporators 120 and 130 is introduced, the injection port 112, into which relatively low pressure refrigerant, evaporated in the injection module via heat exchange, is provided, and the outlet port 113, from which the compressed refrigerant is discharged to the condensers 120 and 130 by passing through the switching valve 180.

The compressor 110 may compress the refrigerant, introduced through the inlet port 111, in a compression chamber, and combine the refrigerant, introduced through the injection port 112, with the refrigerant introduced through the inlet port 111, while compressing the refrigerant introduced through the inlet port 111. The compressor 110 may compress the combined refrigerant and discharges together through the outlet port 113. The refrigerant discharged from the outlet port 113 then flows to the switching valve 180.

The switching valve 180 may serve as a path switching valve 180 for switching between cooling and heating, and guide the refrigerant compressed in the compressor 110 to the outdoor heat exchanger 120 during a cooling operation and to the indoor heat exchanger 130 during a heating operation.

The switching valve 180 may be connected to the outlet port 113 of the compressor 110 and to the gas-liquid separator 140. The switching valve 180 may also be connected to the indoor heat exchanger 130 and the outdoor heat exchanger 120.

During a cooling operation, for example, the switching valve 180 interconnects the outlet port 113 of the compressor 110 and the outdoor heat exchanger 120, and interconnects the indoor heat exchanger 130 and the gas-liquid separator 140, or the indoor heat exchanger 130 and the inlet port 111 of the compressor 110.

During a heating operation, for example, the switching valve 180 interconnects the outlet port 113 of the compressor 110 and the indoor heat exchanger 130, and interconnects the outdoor heat exchanger 120 and the gas-liquid separator 140, or the outdoor heat exchanger 120 and the inlet port 111 of the compressor 110.

Although the switching valve 180 may be implemented in various modules capable of interconnecting different flowpaths, in the present embodiment, for example, the switching valve 180 is a 4-way valve. However, in some embodiments, the switching valve 180 may be any of a variety of valve types or a combination thereof, such as a combination of two 3-way valves.

The outdoor heat exchanger 120 is installed in the outdoor unit, which is located in an outdoor space. The outdoor heat exchanger 120 performs heat exchange between the refrigerant passing therethrough and the outdoor air. The outdoor heat exchanger 120 operates as a condenser for condensing refrigerant during a cooling operation, and operates as an evaporator for evaporating refrigerant during a heating operation.

The outdoor heat exchanger 120 may be connected to the switching valve 180 and the outdoor expansion valve 150.

During a cooling operation, for example, the refrigerant that has been compressed in the compressor 110 and has passed through the outlet port 113 of the compressor 110 and the switching valve 180 is introduced into the outdoor heat exchanger 120 so as to be condensed therein, and thereafter flows to the outdoor expansion valve 150.

During a heating operation, for example, the refrigerant expanded in the outdoor expansion valve 150 flows to the outdoor heat exchanger 120 so as to be evaporated therein, and thereafter flows to the switching valve 180.

The outdoor expansion valve 150 may be fully opened so that the refrigerant passes therethrough during a cooling operation. During a heating operation, the opening degree of the outdoor expansion valve 150 may be adjusted so as to expand the refrigerant during a heating operation.

The outdoor expansion valve 150 is provided between the outdoor heat exchanger 120 and an overcooling heat-exchange hub 190. However, in some embodiments, the outdoor expansion valve 150 may be provided between the outdoor heat exchanger 120 and an injection heat exchanger 17.

During a cooling operation, the outdoor expansion valve 150 passes the refrigerant introduced from the outdoor heat exchanger 120, and guides the refrigerant to the overcooling heat-exchange hub 190.

During a heating operation, the outdoor expansion valve 150 expands the refrigerant that has undergone heat exchange in the injection module and has passed through the overcooling heat-exchange hub 190, and guides the expanded refrigerant to the outdoor heat exchanger 120.

The indoor heat exchanger 130 is installed in the indoor unit, which is located in an indoor space, and performs heat exchange between the refrigerant passing therethrough and indoor air. The indoor heat exchanger 130 operates as an evaporator for evaporating refrigerant during a cooling operation, and operates as a condenser for condensing refrigerant during a heating operation.

The indoor heat exchanger 130 may be connected to the switching valve 180 and the indoor expansion valve 160.

During a cooling operation, the refrigerant expanded in the indoor expansion valve 160 is introduced into the indoor heat exchanger 130 so as to be evaporated therein, and thereafter flows to the switching valve 180.

During a heating operation, the refrigerant that has been compressed in the compressor 110 and has passed through the outlet port 113 of the compressor 110 and the switching valve 180 is introduced into the indoor heat exchanger 130 so as to be condensed therein, and thereafter flows to the indoor expansion valve 160.

During a cooling operation, the opening degree of the indoor expansion valve 160 may be adjusted so as to expand the refrigerant. During a heating operation, the indoor expansion valve 160 may be completely opened to pass the refrigerant. The indoor expansion valve 160 may be provided between the indoor heat exchanger 130 and the injection heat exchanger 17.

During a cooling operation, the indoor expansion valve 160 expands the refrigerant moved to the indoor heat exchanger 130. During a heating operation, the indoor expansion valve 160 passes the refrigerant introduced from the indoor heat exchanger 130, and guides the refrigerant to the injection heat exchanger 17.

The gas-liquid separator 140 may be provided between the compressor 110 and the switching valve 180, and separates the refrigerant into liquid-phase refrigerant and gas-phase refrigerant. For example, as shown, the gas-liquid separator 140 is provided between the switching valve 180 and the inlet port 111 of the compressor 110.

The gas-liquid separator 140 may be connected to the switching valve 180 and the inlet port 111 of the compressor 110. For example, as shown, the gas-liquid separator 140 is located in an inlet pipe 114, which is connected to the indoor heat exchanger 130 and the inlet port 111 of the compressor 110. More specifically, the gas-liquid separator 140 is located in the inlet pipe 114 between the inlet port 111 of the compressor 110 and the switching valve 180.

The gas-liquid separator 140 separates the refrigerant evaporated in the indoor heat exchanger 130 during a cooling operation, or the refrigerant evaporated in the outdoor heat exchanger 120 during a heating operation, into liquid-phase refrigerant and gas-phase refrigerant, and guides the gas-phase refrigerant to the inlet port 111 of the compressor 110. Specifically, for example, the gas-liquid separator 140 separates the refrigerant evaporated in the evaporators 120 and 130 into gas-phase refrigerant and liquid-phase refrigerant and guides the gas-phase refrigerant to the inlet port 111 of the compressor 110.

The refrigerant evaporated in the outdoor heat exchanger 120 or the indoor heat exchanger 130 may be introduced into the gas-liquid separator 140 by way of the switching valve 180. Accordingly, for example, the gas-liquid separator 140 may maintain a temperature of approximately 0~5° C., and may radiate cold energy to the outside. The temperature of the surface of the gas-liquid separator 140 is lower than the temperature of the refrigerant condensed in the outdoor heat exchanger 120 during a cooling operation. The gas-liquid separator 140 may have a longitudinally elongated cylindrical shape (not limited thereto).

A gas-liquid separator jacket 200 is provided so as to surround the surface of the gas-liquid separator 140. The gas-liquid separator jacket 200 may be in thermal contact with the surface of the gas-liquid separator 140. The gas-liquid separator jacket 200 is preferably formed of a material having high thermal conductivity to perform heat exchange between the gas-liquid separator 140 and brine.

In detail, for example, the gas-liquid separator jacket 200 is installed so that the inner circumferential surface thereof contacts the outer circumferential surface of the gas-liquid separator 140. The gas-liquid separator jacket 200 may be formed so as to correspond to the length of the gas-liquid separator 140 in order to facilitate heat exchange between the gas-liquid separator 140 and brine.

The gas-liquid separator jacket 200 may be connected to the overcooling heat-exchange hub 190, a circulation pump 191, and the gas-liquid separator 140. The brine for undergoing heat exchange with the gas-liquid separator 140 flows inside the gas-liquid separator jacket 200. The gas-liquid separator jacket 200 may include a flow path (not illustrated) for moving the brine along the surface of the gas-liquid separator 140. Accordingly, the brine, introduced from the overcooling heat-exchange hub 190 into the gas-liquid separator jacket 200 by the driving of the circulation pump 191, undergoes heat exchange with the gas-liquid separator 140 while moving along the surface of the gas-liquid separator 140. The brine that has undergone heat exchange with the gas-liquid separator 140 is then introduced into the overcooling heat-exchange hub 190.

The overcooling heat-exchange hub 190 may be provided between the indoor heat exchanger 130 and the outdoor heat exchanger 120. The overcooling heat-exchange hub 190 may be connected to the gas-liquid separator jacket 200, the injection heat exchanger 17, the circulation pump 191, and the outdoor expansion valve 150. Accordingly, the brine that has absorbed cold energy radiated from the gas-liquid separator 140 may be stored inside the overcooling heat-exchange hub 190. Also, because the overcooling heat-exchange hub 190 is connected to the circulation pump 191, the brine stored in the overcooling heat-exchange hub 190 may be forcibly moved to the gas-liquid separator jacket 200.

The overcooling heat-exchange hub 190 may accommodate a pipe installed therein for the flow of the refrigerant that has been condensed in the outdoor heat exchanger 120 during a cooling operation and has passed through the outdoor expansion valve 150. Accordingly, with such configuration, heat exchange between the brine and the refrigerant condensed in the outdoor heat exchanger 120 occurs inside the overcooling heat-exchange hub 190 during a cooling operation. At this time, the temperature of the brine is lower than the temperature of the refrigerant condensed in the outdoor heat exchanger 120. Thereby, the temperature of the brine is raised and the temperature of the condensed refrigerant is lowered, whereby overcooling occurs.

The pipe, which is installed inside the overcooling heat-exchange hub 190 for the movement of the refrigerant, may extend in a zigzag shape. As such, the heat exchange process between the brine and the refrigerant inside the overcooling heat-exchange hub 190 may be extended. It is understood that the overcooling heat-exchange hub 190 may be as large as possible in order to store as much brine as possible.

The circulation pump 191 operates to forcibly circulate the brine, which flows through the overcooling heat-exchange hub 190 and the gas-liquid separator jacket 200.

During a cooling operation, for example, the circulation pump 191 is driven to forcibly circulate the brine, thereby allowing the brine, which has undergone heat exchange with the gas-liquid separator 140, to be stored in the overcooling heat-exchange hub 190.

During a heating operation, for example, the circulation pump 191 is not driven, and thus cannot forcibly circulate the brine. However, even when the circulation pump 191 is not driven during a heating operation, natural circulation of the brine may occur via convection, which may cause the brine to move to the gas-liquid separator jacket 200 so as to undergo heat exchange with the gas-liquid separator 140.

The circulation pump 191 may be provided between the overcooling heat-exchange hub 190 and the gas-liquid separator jacket 200. For example, the circulation pump 191 may be a general pump and may be provided in a plural number in order to increase the forcible circulation of the brine. A shutoff valve (not illustrated) may be installed between the gas-liquid separator jacket 200 and the overcooling heat-exchange hub 190 for stopping the movement of the brine. During a heating operation, the shutoff valve may be closed to prevent the movement of the brine by natural circulation. However, during a cooling operation, the shutoff valve must be open because the circulation pump 191 is driven.

The injection module injects at least a portion of the refrigerant discharged from the indoor heat exchanger 130 to the compressor 110.

During a cooling operation, the injection module performs heat exchange between at least a portion of the refrigerant discharged from the indoor heat exchanger 130 and the refrigerant, which flows from the outdoor heat exchanger 120 to the indoor heat exchanger 130, and injects the refrigerant to the compressor 110.

Specifically, for example, during a cooling operation, the injection module performs heat exchange between a portion of the low-temperature and low-pressure refrigerant, which has undergone heat exchange with indoor air in the indoor heat exchanger 130, but has not yet been introduced into the compressor 110, and the high-temperature and high-pressure refrigerant condensed in the outdoor heat exchanger 120, thereby generating medium-temperature and medium-pressure refrigerant. The medium-temperature and medium-pressure refrigerant described above is then injected into the compressor 110. Accordingly, a portion of the refrigerant, which has already undergone heat exchange with outdoor air in the indoor heat exchanger 130, is injected into the compressor 110 during a cooling operation, which results in increased efficiency.

In addition, during a heating operation, the injection module injects at least a portion of the refrigerant, which flows from the indoor heat exchanger 130 to the outdoor heat exchanger 120, to the compressor 110. Specifically, for example, during a heating operation, the injection module diverts and expands a portion of the refrigerant, which has completely undergone heat exchange with indoor air in the indoor heat exchanger 130 to thereby move from the indoor heat exchanger 130 to the outdoor heat exchanger 120, and performs heat exchange between the expanded refrigerant and a remaining portion of the refrigerant, which flows from the indoor heat exchanger 130 to the outdoor heat exchanger 120. A portion of the heat-exchanged refrigerant, which flows from the indoor heat exchanger 130 to the outdoor heat exchanger 120, is then injected into the compressor 110.

Hereinafter, the detailed configuration of the injection module will be described.

The injection module may include the injection heat exchanger 17 and a first injection expansion valve 176. The injection heat exchanger 17 performs heat exchange between the refrigerant discharged from the indoor heat exchanger 130 and the refrigerant, which flows from the outdoor heat exchanger 120 to the indoor heat exchanger 130, during a cooling operation. The first injection expansion valve 176 expands the refrigerant, which flows between the injection heat exchanger 17 and the compressor 110.

During a cooling operation, the injection heat exchanger 17 may perform heat exchange between the refrigerant discharged from the indoor heat exchanger 130 and the refrigerant, which flows from the outdoor heat exchanger 120 to the indoor heat exchanger 130. For example, the injection heat exchanger 17 may be installed inside a pipe 17*c*, which is provided for the flow of the refrigerant, which has been condensed in the outdoor heat exchanger 120 during a cooling operation and has passed through the outdoor expansion valve 150. Thereby, the refrigerant discharged from the indoor heat exchanger 130 passes through the interior of the injection heat exchanger 17.

The injection heat exchanger 17 may be connected to the compressor 110, the switching valve 180, the indoor heat exchanger 130, and the outdoor heat exchanger 120. Specifically, for example, an inlet port 17*a* of the injection heat exchanger 17 is connected to both the switching valve 180 and the compressor 110, and an outlet port 17*b* of the injection heat exchanger 17 is connected to the injection port 112 of the compressor 110.

Accordingly, during a cooling operation, heat exchange between the refrigerant condensed in the outdoor heat exchanger 120 and the refrigerant evaporated in the indoor heat exchanger 130 occurs inside the injection heat exchanger 17. The temperature of the evaporated refrigerant is thus raised and the temperature of the condensed refrigerant is lowered.

More specifically, the injection module may include a cooling bypass pipe 172 and a check valve 174.

The cooling bypass pipe 172 may interconnect the indoor heat exchanger 130 and the injection heat exchanger 17. Specifically, for example, one end of the cooling bypass pipe 172 is connected to the inlet pipe 114, which interconnects the switching valve 180 and the compressor 110, and the other end of the cooling bypass pipe 172 is connected to the injection heat exchanger 17. During a cooling operation, the cooling bypass pipe 172 diverts the refrigerant discharged from the indoor heat exchanger 130 to the injection heat exchanger 17. More specifically, for example, the other end of the cooling bypass pipe 172 is connected to a heating bypass pipe 177, and the other end of the cooling bypass pipe 172 is connected to the heating bypass pipe 177 between the injection heat exchanger 17 and a second injection expansion valve 171.

The cooling bypass pipe 172 may diverge from the inlet pipe 114, which is connected to the indoor heat exchanger 130 and the inlet port 111 of the compressor 110. The cooling bypass pipe 172 may thus divert at least a portion of the refrigerant introduced from the switching valve 180 to the gas-liquid separator 140.

The check valve 174 may be installed in the cooling bypass pipe 172 to prevent the refrigerant from flowing from the injection heat exchanger 17 to the indoor heat exchanger 130 during a heating operation and also to allow the refrigerant having passed through the switching valve 180 to be introduced into the injection heat exchanger 17 during a cooling operation.

The injection module may further include an injection pipe 175 to interconnect the injection heat exchanger 17 and the compressor 110, and a first injection expansion valve 176 installed in the injection pipe 175. A portion of the refrigerant discharged from the indoor heat exchanger 130 may thus undergo heat exchange in the injection heat exchanger 17, and then be introduced into the injection pipe 175.

One end of the injection pipe 175 may be connected to the injection heat exchanger 17, and the other end of the injection pipe 175 may be connected to the injection port 112 of the compressor 110. The injection pipe 175 may be directly or indirectly connected to the heat exchanger 17 and the injection port 112. The refrigerant having passed through the cooling bypass pipe 172 flows through the injection pipe 175.

The first injection expansion valve 176 expands the refrigerant, which flows between the injection heat exchanger 17 and the compressor 110. The opening degree of the first injection expansion valve 176 may be adjusted during a cooling operation so as to adjust the flow rate of the refrigerant to be injected into the compressor 110. The first injection expansion valve 176 may be open during a heating operation and a cooling operation. Specifically, for example, the first injection expansion valve 176 may be fully open during a heating operation.

The injection module may further include a second injection expansion valve 171 for expanding a portion of the refrigerant, which flows from the indoor heat exchanger 130 to the outdoor heat exchanger 120 during a heating operation, and a heating bypass pipe 177 for diverting a portion of the refrigerant that flows from the indoor heat exchanger 130 to the outdoor heat exchanger 120, whereby the second injection expansion valve 171 is provided in the heating bypass pipe 177.

At this time, the injection heat exchanger 17 performs heat exchange between the refrigerant expanded in the second injection expansion valve 171 and a remaining portion of the refrigerant, which flows from the indoor heat exchanger 130 to the outdoor heat exchanger 120 during a heating operation. During a cooling operation, the injection heat exchanger 17 may perform heat exchange between the refrigerant discharged from the indoor heat exchanger 130 and the refrigerant, which flows from the outdoor heat exchanger 120 to the indoor heat exchanger 130. During a heating operation, the injection heat exchanger 17 may perform heat exchange between a portion of the refrigerant, which moves from the indoor heat exchanger 130 to the outdoor heat exchanger 120, and a remaining portion of the refrigerant.

The injection heat exchanger 17 may be connected to the first injection expansion valve 176, the second injection expansion valve 171, the overcooling heat-exchange hub 190, the compressor 110, and the indoor expansion valve 160. During a heating operation, the injection heat exchanger 17 may perform heat exchange between the refrigerant expanded in the second injection expansion valve 171 and the refrigerant, which flows from the indoor heat exchanger 130 to the outdoor heat exchanger 120. The injection heat exchanger 17 may guide the heat-exchanged refrigerant into the compressor 110. That is, for example, during a heating operation, the refrigerant, which has undergone heat exchange in the injection heat exchanger 17, is evaporated and introduced into the injection port 112 of the compressor 110.

The heating bypass pipe 177 interconnects the indoor heat exchanger 130 and the injection heat exchanger 17. Specifically, for example, one end of the heating bypass pipe 177 is connected to a pipe, which interconnects the indoor heat exchanger 130 and the outdoor heat exchanger 120. The other end of the heating bypass pipe 177 is connected to the injection heat exchanger 17. The heating bypass pipe 177 diverts a portion of the refrigerant, which flows from the indoor heat exchanger 130 to the outdoor heat exchanger 120, to the injection heat exchanger 17 during a heating operation.

The heating bypass pipe 177 may be connected to the injection heat exchanger 17 separately from the cooling bypass pipe 172, or may be combined with the cooling bypass pipe 172 and be connected to the injection heat exchanger 17. The refrigerant having passed through the heating bypass pipe 177 and the injection heat exchanger 17 may thus be injected into the compressor 110 through the injection pipe 175.

During a heating operation, the second injection expansion valve 171 expands at least a portion of the refrigerant, which flows from the indoor heat exchanger 130 to the outdoor heat exchanger 120. The second injection expansion valve 171 may be open during a heating operation and closed during a cooling operation.

The second injection expansion valve 171 may be connected to the indoor expansion valve 160 and the injection heat exchanger 17. The second injection expansion valve 171 functions to expand a portion of the refrigerant, which has been discharged from the indoor heat exchanger 130 and has passed through the indoor expansion valve 160, and guide the refrigerant to the injection heat exchanger 17 during a heating operation.

The operation of the air conditioner having the above-described configuration in accordance with an embodiment of the present invention is described below.

Figure 3:
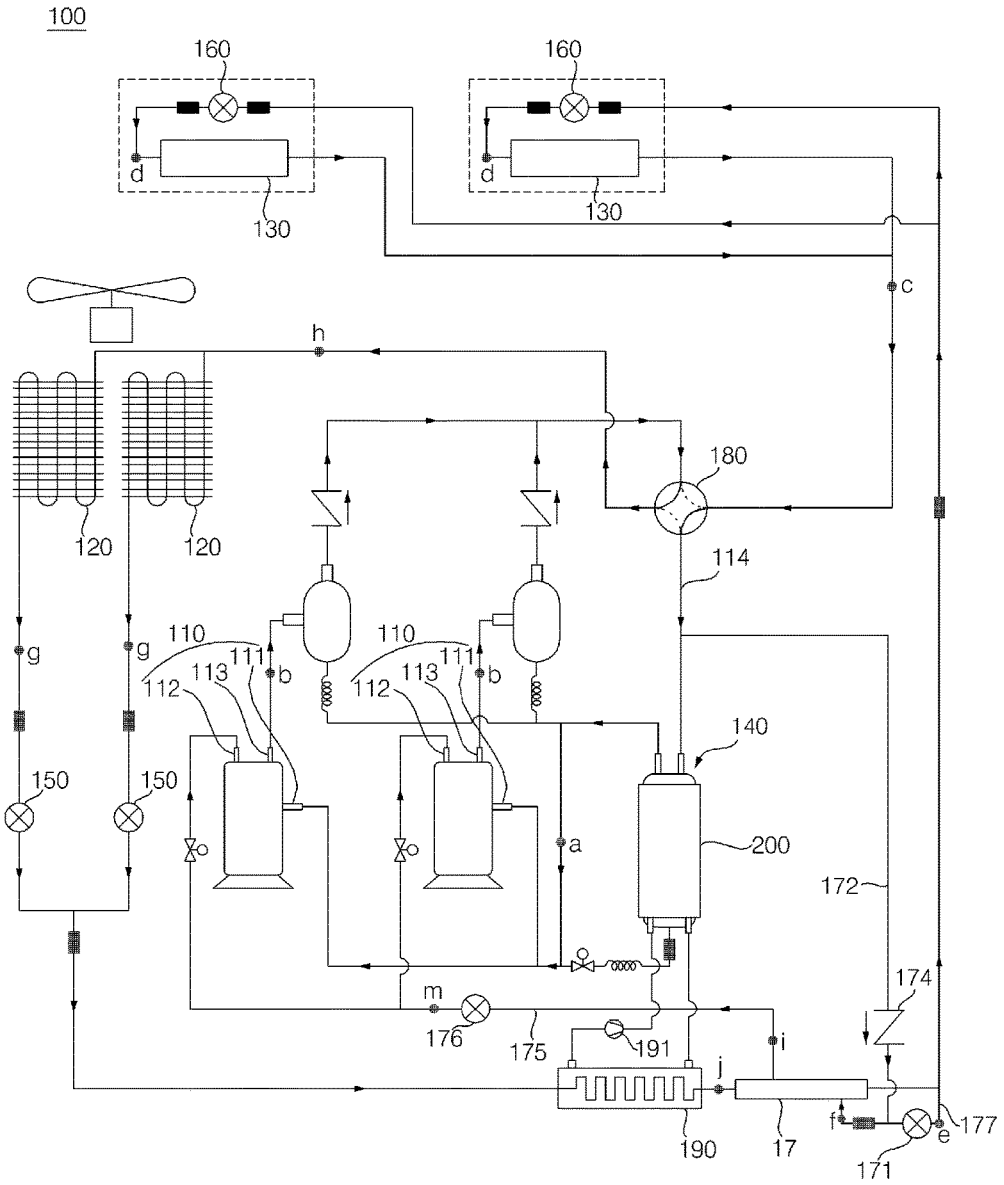
FIG. 3 is a view illustrating the flow of refrigerant during a cooling operation of the air conditioner in accordance with one embodiment of the present invention.
Figure 4:
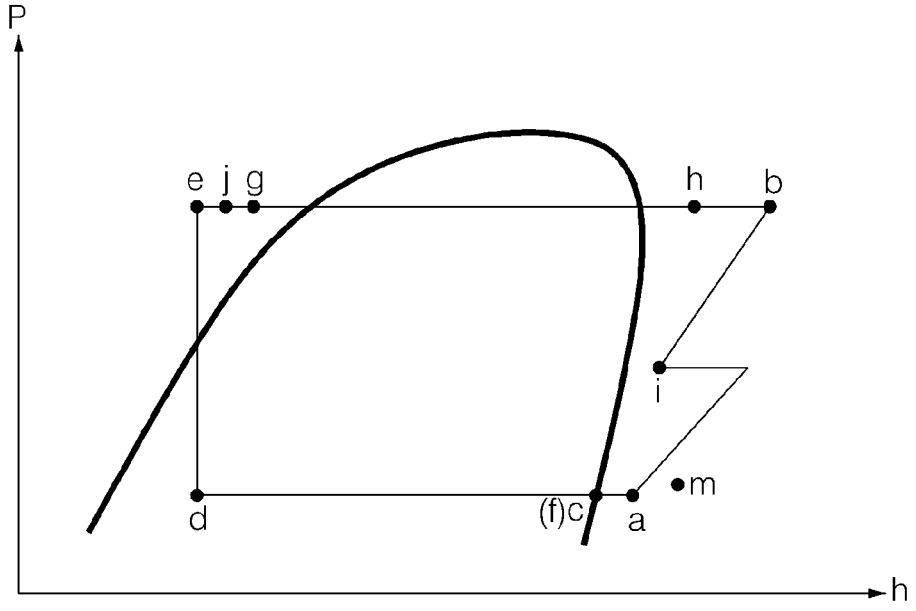
FIG. 4 is a pressure-enthalpy diagram (P-H diagram) during the cooling operation of the air conditioner illustrated in FIG. 3.

FIG. 3 is a view illustrating the flow of a refrigerant during a cooling operation of the air conditioner in accordance with one embodiment of the present invention. FIG. 4 is a pressure-enthalpy diagram (P-H diagram) during the cooling operation of the air conditioner illustrated in FIG. 3.

Hereinafter, the operation of the air conditioner 100 in accordance with one embodiment of the present invention during a cooling operation will be described with reference to FIGS. 3 and 4.

As shown in FIG. 3, refrigerant compressed in the compressor 110 may be discharged from the outlet port 113 and flow to the switching valve 180. The refrigerant, discharged from the outlet port 113 passes through a point "b". At this time, the refrigerant at the point "b" is in a high-temperature and high-pressure state, such as illustrated in FIG. 4.

Because the switching valve 180 interconnects the outlet port 113 of the compressor 110 and the outdoor heat exchanger 120 during a cooling operation, the refrigerant that flows to the switching valve 180 passes through a point "h" and flows to the outdoor heat exchanger 120. The refrigerant passing through point "h" remains at the same pressure, but is slightly lowered in temperature as compared with the refrigerant at the point "b".

The refrigerant that flows from the switching valve 180 to the outdoor heat exchanger 120 is condensed via heat exchange with outdoor air in the outdoor heat exchanger 120. The refrigerant condensed in the outdoor heat exchanger 120 passes through a point "g" and moves to the outdoor expansion valve 150. The condensed refrigerant at the point "g" remains at the same pressure, but is greatly lowered in temperature compared to the refrigerant at the point "h".

The refrigerant condensed in the outdoor heat exchanger 120 flows to the outdoor expansion valve 150. During a cooling operation, the outdoor expansion valve 150 may be fully open so that the refrigerant passes, thereby guiding the refrigerant to the overcooling heat-exchange hub 190.

During a cooling operation, the brine stored in the overcooling heat-exchange hub 190 may be forcibly moved to the gas-liquid separator jacket 200 via the driving of the circulation pump 191. The brine moved from the overcooling heat-exchange hub 190 to the gas-liquid separator jacket 200 is lowered in temperature via heat exchange with the gas-liquid separator 140. The low-temperature brine, which has undergone heat exchange with the gas-liquid separator 140, may then be stored in the overcooling heat-exchange hub 190 via the driving of the circulation pump 191.

The refrigerant that flows from the outdoor expansion valve 150 to the overcooling heat-exchange hub 190 may flow through a pipe installed inside the overcooling heat-exchange hub 190. The refrigerant undergoes heat exchange with the brine while flowing through the pipe. The refrigerant, which has undergone heat exchange in the overcooling heat-exchange hub 190, may then pass through a point "j" and flow to the injection heat exchanger 17. The refrigerant at the point "j" remains at the same pressure, but is lowered in temperature compared to the refrigerant at the point "h".

Thus, because the second injection expansion valve 171 of the injection module is closed and the first injection expansion valve 176 is open during a cooling operation, the refrigerant having passed through the point "j" undergoes heat exchange with at least a portion of the refrigerant discharged from the injection heat exchanger 17. The refrigerant having passed through the injection heat exchanger 17 passes through a point "e" and flows to the indoor expansion valve 160. The refrigerant at the point "e" remains at the same pressure, but is lowered in temperature compared to the refrigerant at the point "j".

The refrigerant that flows to the indoor expansion valve 160 passes through a point "d" and moves to the indoor heat exchanger 130. The refrigerant having passed through the point "d" remains at the same temperature, but has a significantly lower pressure compared to the refrigerant at the point "e". However, in some embodiments, the refrigerant passing through the point "d" may be slightly lowered in temperature and may be significantly lowered in pressure compared to the refrigerant at the point "e".

The refrigerant moved to the indoor heat exchanger 130 is evaporated via heat exchange with indoor air in the indoor heat exchanger 130. The refrigerant evaporated in the indoor heat exchanger 130 passes through a point "c" and flows to the switching valve 180. The refrigerant having passed through the point "C" remains at the same pressure but has a higher temperature compared to the refrigerant at the point "d". The temperature of the refrigerant at point "c" may be significantly higher compared to the refrigerant at point "d".

Thus, for example, because the switching valve 180 interconnects the indoor heat exchanger 130 and the gas-liquid separator 140 and/or the compressor 110 during a cooling operation, the refrigerant that flows from the indoor heat exchanger 130 to the switching valve 180 is introduced into the gas-liquid separator 140. The refrigerant introduced into the gas-liquid separator 140 is separated into gas-phase refrigerant and liquid-phase refrigerant. The gas-phase refrigerant passes through a point "a" and moves to the inlet port 111 of the compressor 110. The refrigerant having passed through the point "a" remains at the same pressure, but has a higher temperature compared to the refrigerant at the point "c". This is because only the gas-phase refrigerant having a relatively high temperature among the refrigerant introduced into the gas-phase separator 140 flows to the inlet port 111 of the compressor 110. The temperature of the refrigerant at point "a" may be significantly higher compared to the refrigerant at point "c".

The refrigerant moved to the inlet port 111 is then compressed in the compressor 110, and thereafter discharged via the outlet port 113. That is, for example, the refrigerant introduced into the compressor 110 is compressed, thus becoming high-temperature and high-pressure refrigerant at the point "b" shown in FIG. 4.

A portion of the refrigerant, which has passed through the switching valve 180, but has not yet been introduced into the gas-liquid separator 140, may be diverted to the cooling bypass pipe 172 so as to pass through a point "f" and be introduced into the injection heat exchanger 17. The refrigerant having passed through the point "f" undergoes heat exchange in the injection heat exchanger 17, and thereafter, passes through a point "i" and is introduced into the injection pipe 175. The refrigerant at the point "i" has a higher temperature compared to the refrigerant at the point "f". Alternatively, the refrigerant at the point "i" has higher temperature and pressure compared to the refrigerant at the point "f".

The refrigerant having passed through the point "i" flows to the injection port 112 of the compressor 110.

Accordingly, for example, when the injection module is used during a cooling operation, the overcooling degree and the cooling ability are increased and the enthalpy of the refrigerant suctioned into the compressor 110 is increased, which reduces power consumption of the compressor 110.

Figure 5:
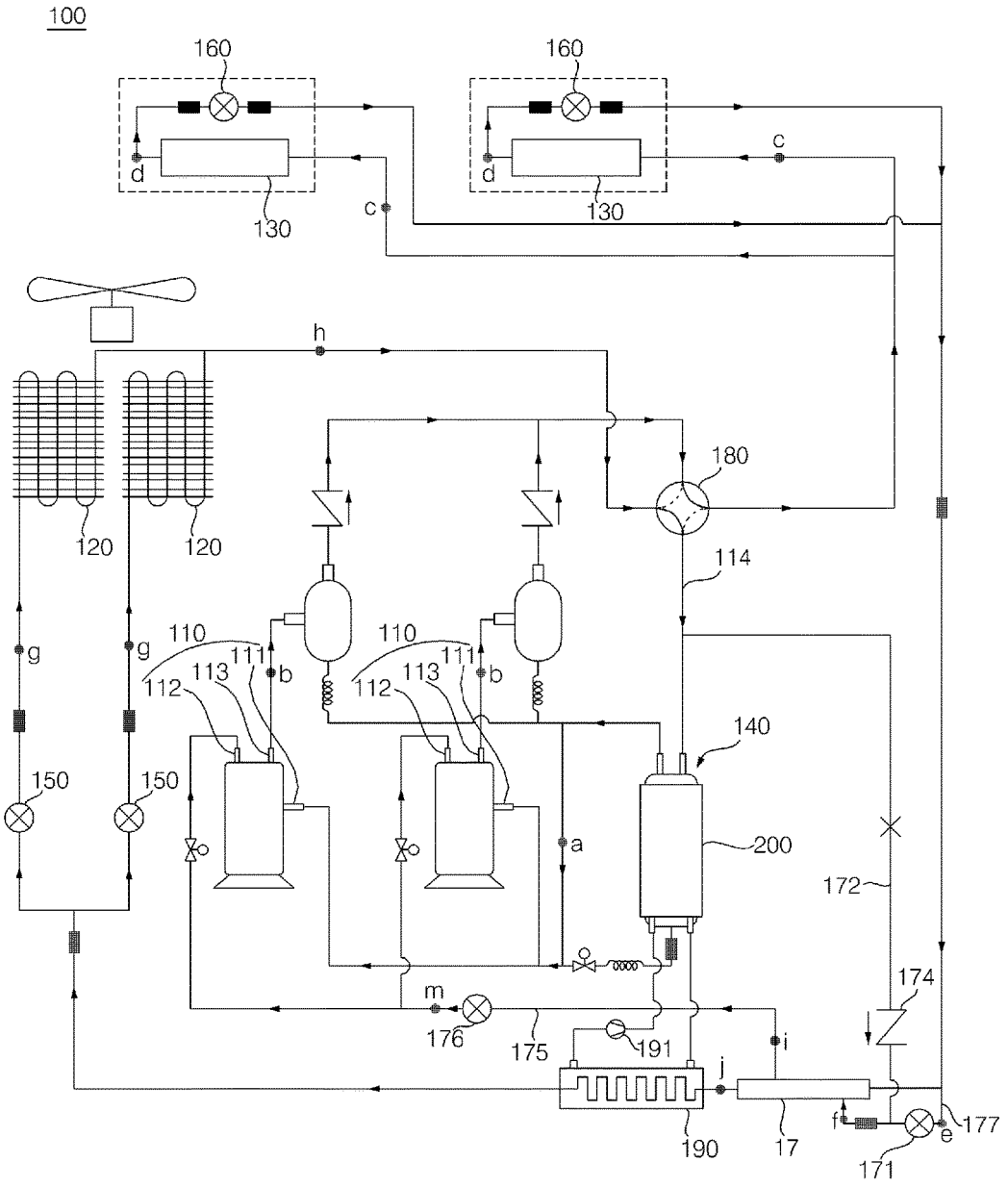
FIG. 5 is a view illustrating the flow of refrigerant during a heating operation of the air conditioner in accordance with one embodiment of the present invention.
Figure 6:
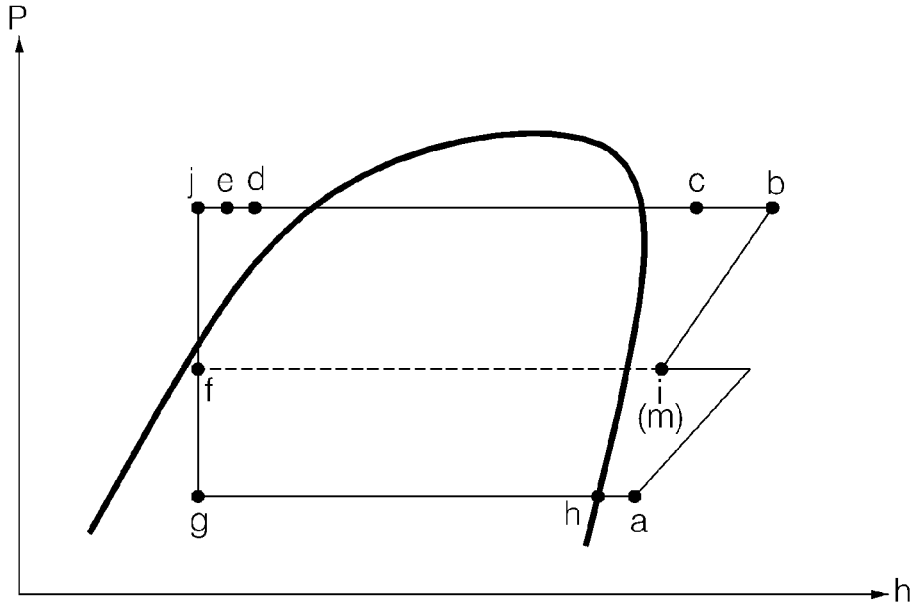
FIG. 6 is a pressure-enthalpy diagram (P-H diagram) during the heating operation of the air conditioner illustrated in FIG. 5.

FIG. 5 is a view illustrating the flow of a refrigerant during a heating operation of the air conditioner in accordance with one embodiment of the present invention. FIG. 6 is a pressure-enthalpy diagram (P-H diagram) during the heating operation of the air conditioner illustrated in FIG. 5.

Hereinafter, the operation of the air conditioner 100 in accordance with one embodiment of the present invention during a heating operation will be described with reference to FIGS. 5 and 6.

As shown in FIG. 5, refrigerant compressed in the compressor 110 is discharged from the outlet port 113 and flows to the switching valve 180. The refrigerant discharged from the outlet port 113 then passes through a point "b". At this time, the refrigerant at the point "b" is in a high-temperature and high-pressure state, such as illustrated in FIG. 6.

Thus, for example, because the switching valve 180 interconnects the outlet port 113 of the compressor 110 and the indoor heat exchanger 130 during a heating operation, the refrigerant moved to the switching valve 180 passes through a point "c" and flows to the indoor heat exchanger 130. The refrigerant passing through the point "c" remains at the same pressure, but has a lower temperature compared to the refrigerant at the point "b". The temperature of the refrigerant at point "c" may be slightly lower compared to the refrigerant at point "b".

The refrigerant may then be condensed via heat exchange with indoor air in the indoor heat exchanger 130. For example, the refrigerant condensed in the indoor heat exchanger 130 passes through a point "d" and flows to the indoor expansion valve 160. The refrigerant at the point "d" remains at the same pressure, but has a lower temperature compared to the refrigerant at the point "c" due to condensation in the indoor heat exchanger 130. The temperature of the refrigerant at point "d" may be significantly lower compared to the refrigerant at point "c".

The refrigerant condensed in the indoor heat exchanger 130 may flow to the indoor expansion valve 160. During a heating operation, the indoor expansion valve 160 may be fully open so that the refrigerant passes, thereby guiding the refrigerant to the injection heat exchanger 17.

Thus, for example, because the second injection expansion valve 171 of the injection module is open and the first injection expansion valve 176 is completely open during a heating operation, a portion of the refrigerant having passed through the indoor expansion valve 160 flows through a point "e" and moves to the second injection expansion valve 171. The refrigerant having passed through the point "e" remains at the same pressure, but has a lower temperature compared to the refrigerant having passed through the point "d". The temperature of the refrigerant at point "e" may be slightly lower compared to the refrigerant at point "d".

During a heating operation, the opening degree of the second injection expansion valve 171 may be adjusted so as to expand the refrigerant. Accordingly, for example, the refrigerant, moved to and expanded by the second injection expansion valve 171, flows through a point "f" and moves to the injection heat exchanger 17. The refrigerant passing through the point "f" remains at the same temperature, but has a lower pressure compared to the refrigerant at the point "e". The check valve 174 prevents the refrigerant passing through the point "f" from moving to the switching valve 180.

The refrigerant expanded in the second injection expansion valve 171 may then be guided to the injection heat exchanger 17 and pass through the indoor expansion valve 160, thereby being evaporated via heat exchange with the refrigerant, which moves to the outdoor heat exchanger 120. For example, the evaporated refrigerant flows through a point "i" and moves to the injection port 112 of the compressor 110. The refrigerant passing through the point "i" remains at the same pressure, but has a higher temperature compared to the refrigerant at the point "f". Alternatively, the refrigerant passing through the point "i" has a higher temperature and pressure than the refrigerant passing through a point "a", which will be described below.

Among the refrigerant moving from the indoor expansion valve 160 to the outdoor heat exchanger 120, for example, the portion of refrigerant that is not introduced into the second injection expansion valve 171 is overcooled via heat exchange with the refrigerant expanded in the second injection expansion valve 171. The overcooled refrigerant passes through a point "j" and moves to the overcooling heat-exchange hub 190. The refrigerant having passed through the point "j" remains at the same pressure, but has a lower temperature compared to the refrigerant at the point "e".

The circulation pump 191 is not driven during a heating operation, and thus the brine is not forcibly circulated. Accordingly, the brine may not undergo heat exchange with the gas-liquid separator 140. Therefore, the refrigerant having passed through the overcooling heat-exchange hub 190 may exhibit almost no variation in pressure and temperature compared to the refrigerant at the point "j". The refrigerant having passed through the overcooling heat-exchange hub 190 moves to the outdoor expansion valve 150.

However, in some embodiments, the brine may be circulated to the gas-liquid separator jacket 200 due to natural circulation even when the circulation pump 191 is not driven. The brine may absorb cold energy of the gas-liquid separator 140 via natural circulation, and may be stored in the overcooling heat-exchange hub 190. Accordingly, the refrigerant having passed through the overcooling heat-exchange hub 190 may remain at the same pressure, but may have a lower temperature compared to the refrigerant at the point "j". The temperature of the refrigerant passed through the overcooling heat-exchange hub 190 may be slightly lower compared to the refrigerant at point "j".

The refrigerant moved to the outdoor expansion valve 150 is then expanded, and passes through a point "g" and moves to the outdoor heat exchanger 120. The refrigerant passing through the point "g" remains at the same temperature, but has a lower pressure compared to the refrigerant having passed through the overcooling heat-exchange hub 190 or the refrigerant at the point "j". The pressure of the refrigerant passed through point "g" may be significantly lower compared to the refrigerant at the point "j".

However, in some embodiments, the refrigerant passing through the point "g" may have a lower temperature and a lower pressure compared to the refrigerant having passed through the overcooling heat-exchange hub 190 or the refrigerant at the point "j". For example, the refrigerant passing through point "g" may have a slightly lower temperature and a significantly lower pressure compared to the refrigerant passed through the overcooling heat-exchange hub 190 or the refrigerant at point "j".

The refrigerant expanded in the outdoor expansion valve 150 may then moves to the outdoor heat exchanger 120, and in turn, the refrigerant moved to the outdoor heat exchanger 120 may be evaporated via heat exchange with outdoor air. For example, the refrigerant evaporated in the outdoor heat exchanger 120 passes through a point "h" and moves to the switching valve 180. The refrigerant passing through the point "h" remains at the same pressure, but has a higher temperature compared to the refrigerant at the point "g". The temperature of the refrigerant passed through point "h" may be significantly higher compared to the refrigerant at point "g".

Thus, for example, because the switching valve 180 interconnects the outdoor heat exchanger 120 and the gas-liquid separator 140 during a heating operation, the refrigerant moved from the outdoor heat exchanger 120 to the switching valve 180 may be introduced into the gas-liquid separator 140. The refrigerant introduced into the gas-liquid separator 140 is separated into gas-phase refrigerant and liquid-phase refrigerant. The gas-phase refrigerant passes through a point "a" and moves to the inlet port 111 of the compressor 110. The refrigerant having passed through the point "a" remains at the same pressure, but has a higher temperature compared to the refrigerant at the point "c". This is because only the gas-phase refrigerant having a relatively high temperature among the refrigerant introduced into the gas-phase separator 140 moves to the inlet port 111 of the compressor 110. The temperature of the refrigerant passed through point "a" may be slightly higher compared to the refrigerant at point "c".

The refrigerant moved to the inlet port 111 may be compressed in the compressor 110. During compression, the refrigerant is combined in the injection port 112 with the refrigerant evaporated in the injection module. Thereby, the temperature and pressure of the refrigerant being compressed are lowered to those at the point "i". After such combination, the combined refrigerant is again compressed, thus becoming high-temperature and high-pressure refrigerant at the point "b". The high-temperature and high-pressure refrigerant is discharged through the outlet port 113. As the refrigerant having passed through the point "i" is injected into the compressor 110, the temperature of the refrigerant discharged through the outlet port 113 is lowered compared to the temperature when the refrigerant is not injected. This may prevent an overload of the compressor 110.

Figure 7:
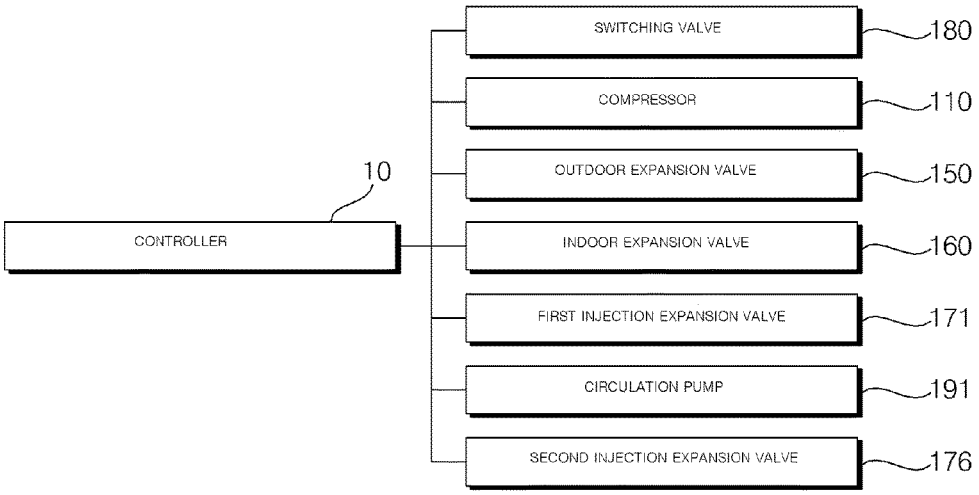
FIG. 7 is a block diagram illustrating the air conditioner in accordance with one embodiment of the present invention.

FIG. 7 is a block diagram illustrating the air conditioner in accordance with one embodiment of the present invention. The operating steps of the air conditioner 100 during a cooling operation in accordance with one embodiment of the present invention will be described below with reference to FIG. 7.

A controller 10 controls the air conditioner to perform a cooling operation. When the controller 10 switches the switching valve 180 upon beginning the cooling operation, the switching valve 180 interconnects the outlet port 113 of the compressor 110 and the outdoor heat exchanger 120, thus guiding the refrigerant discharged from the compressor 110 to the outdoor heat exchanger 120.

When beginning the cooling operation, the controller 10 drives the circulation pump 191 to forcibly circulate brine that may be stored in the overcooling heat-exchange hub 190 to the gas-liquid separator jacket 200. The brine forcibly circulated to the gas-liquid separator jacket 200 may then be cooled via heat exchange with the gas-liquid separator 140. The cooled brine may then move to the overcooling heat-exchange hub 190 and be stored therein.

The refrigerant, which has passed through the outlet port 113 of the compressor 110 and the switching valve 180 and has moved to the outdoor heat exchanger 120, may then undergo a heat exchange process with outdoor air in the outdoor heat exchanger 120. Thereby, the refrigerant passing through the outdoor heat exchanger 120 is condensed.

When beginning the cooling operation, the controller 10 controls the outdoor expansion valve 150 so that it is fully opened in order to guide the refrigerant condensed in the outdoor heat exchanger 120 to the overcooling heat-exchange hub 190. Then, the controller 10 may control heat exchange between the refrigerant and the brine in the overcooling heat-exchange hub 190 so as to overcool the refrigerant. The overcooled refrigerant may then move to the injection heat exchanger 17.

The controller 10 may close the second injection expansion valve 171 and open the first injection expansion valve 176, thereby injecting at least a portion of the refrigerant, which has completely undergone heat exchange with indoor air and has been discharged from the indoor heat exchanger 130, into the compressor 110.

The controller 10 may then cause the refrigerant introduced into the indoor expansion valve 160 to expand by adjusting the opening degree of the indoor expansion valve 160. The refrigerant expanded in the indoor expansion valve 160 may move to the indoor heat exchanger 130. The refrigerant moved to the indoor heat exchanger 130 may be evaporated via heat exchange with indoor air. The refrigerant evaporated in the indoor heat exchanger 130 may move to the switching valve 180.

Thus, when beginning the cooling operation, the controller 10 interconnects the indoor heat exchanger 130 and the gas-liquid separator 140. The refrigerant evaporated in the indoor heat exchanger 130 may move to the gas-liquid separator 140. The refrigerant moved to the gas-liquid separator 140 is then separated into gas-phase refrigerant and liquid-phase refrigerant, and only the gas-phase refrigerant moves to the inlet port 111 of the compressor 110.

The controller 10 may then cause the refrigerant to be compressed by adjusting the operational speed of the compressor 110 based on the control logic of the cooling operation. The high-temperature and high-pressure refrigerant may be discharged from the compressor 110 to the switching valve 180 through the outlet port 113.

As is appreciated from the above disclosure, an air conditioner of the embodiments of the present invention has at least one or more of the following effects.

During a cooling operation, a portion of the refrigerant, which has already undergone heat exchange with outdoor air in an indoor heat exchanger, is injected into a compressor, which advantageously results in increased efficiency.

Additionally, during a cooling operation, the refrigerant is overcooled by collecting cold energy from a portion of the refrigerant, which has already undergone heat exchange with outdoor air in the indoor heat exchanger, thereby advantageously preventing deterioration in the mass flow rate of refrigerant moving to the indoor heat exchanger.

Additionally, the refrigerant is injected into the compressor along different paths during a cooling operation and a heating operation, which advantageously results in increased efficiency of a heating operation and a cooling operation.

It should be noted that effects of the present invention are not limited to the effects of the present invention as mentioned above, and other unmentioned effects of the present invention will be clearly understood by those skilled in the art from the following description.

The above described features, configurations, effects, and the like are included in at least one of the embodiments of the present invention, and should not be limited to only one embodiment. In addition, the features, configurations, effects, and the like as illustrated in each embodiment may be implemented with regard to other embodiments as they are combined with one another or modified by those skilled in the art. Thus, content related to these combinations and modifications should be construed as including in the scope and spirit of the invention as disclosed in the accompanying claims.

What is claimed is:

1. An air conditioner comprising:

a compressor for compressing refrigerant;

an outdoor heat exchanger installed in an outdoor space for performing heat exchange between the refrigerant and outdoor air;

an indoor heat exchanger installed in an indoor space for performing heat exchange between the refrigerant and indoor air;

a switching valve for guiding the refrigerant, discharged from the compressor, to the outdoor heat exchanger during a cooling operation and to the indoor heat exchanger during a heating operation; and an injection module for injecting a portion of the refrigerant, discharged from the indoor heat exchanger, to the compressor, wherein the injection module performs heat exchange between the portion of the refrigerant discharged from the indoor heat exchanger and refrigerant, which moves from the outdoor heat exchanger to the indoor heat exchanger, during the cooling operation, and injects the heat-exchanged refrigerant into the compressor.

2. The air conditioner according to claim 1, wherein the injection module includes:

an injection heat exchanger for performing heat exchange between the refrigerant discharged from the indoor heat exchanger and the refrigerant, which moves from the outdoor heat exchanger to the indoor heat exchanger, during the cooling operation; and a first injection expansion valve for expanding refrigerant, which moves between the injection heat exchanger and the compressor.

3. The air conditioner according to claim 2, wherein the first injection expansion valve is opened during the heating operation and during the cooling operation.

4. The air conditioner according to claim 2, wherein the injection module further includes:

a cooling bypass pipe for diverting the refrigerant discharged from the indoor heat exchanger to the injection heat exchanger during the cooling operation; and a check valve located in the cooling bypass pipe for preventing the refrigerant from moving from the injection heat exchanger to the indoor heat exchanger during the heating operation.

5. The air conditioner according to claim 4, wherein the cooling bypass pipe is diverged from an inlet pipe connected to both the indoor heat exchanger and an inlet port of the compressor.

6. The air conditioner according to claim 5, further comprising a gas-liquid separator located in the inlet pipe, wherein the cooling bypass pipe diverts a portion of refrigerant introduced from the switching valve to the gas-liquid separator.

7. The air conditioner according to claim 2, wherein the injection module further includes an injection pipe for interconnecting the injection heat exchanger and the compressor, the first injection expansion valve being located in the injection pipe.

8. The air conditioner according to claim 1, wherein the injection module injects a portion of the refrigerant, which moves from the indoor heat exchanger to the outdoor heat exchanger, into the compressor during the heating operation.

9. The air conditioner according to claim 8, wherein the injection module includes:

a second injection expansion valve for expanding the portion of the refrigerant, which moves from the indoor heat exchanger to the outdoor heat exchanger, during the heating operation; and an injection heat exchanger for performing heat exchange between a remaining portion of the refrigerant, which moves from the indoor heat exchanger to the outdoor heat exchanger, and the refrigerant expanded in the second injection expansion valve.

10. The air conditioner according to claim 9, wherein the second injection expansion valve is opened during the heating operation and is closed during the cooling operation.

11. The air conditioner according to claim 9, wherein the injection module further includes a heating bypass pipe for diverting the portion of the refrigerant, which moves from the indoor heat exchanger to the outdoor heat exchanger, the second injection expansion valve being located in the heating bypass pipe.

12. The air conditioner according to claim 1, wherein the injection module includes:

an injection heat exchanger for performing heat exchange between the refrigerant discharged from the indoor heat exchanger and the refrigerant, which moves from the outdoor heat exchanger to the indoor heat exchanger during the cooling operation and performing heat exchange between a portion of refrigerant, which moves from the indoor heat exchanger to the outdoor heat exchanger, and a remaining portion of the refrigerant during the heating operation;

a first injection expansion valve for expanding refrigerant, which moves between the injection heat exchanger and the compressor; and a second injection expansion valve for expanding the portion of the refrigerant, which moves from the indoor heat exchanger to the outdoor heat exchanger.

13. The air conditioner according to claim 2, wherein the first injection expansion valve is opened during the heating operation and during the cooling operation, and wherein the second injection expansion valve is opened during the heating operation and is closed during the cooling operation.

14. The air conditioner according to claim 12, wherein the injection module further includes:

a cooling bypass pipe for diverting the refrigerant discharged from the indoor heat exchanger to the injection heat exchanger during the cooling operation; and a check valve located in the cooling bypass pipe for preventing the refrigerant from moving from the injection heat exchanger to the indoor heat exchanger during the heating operation.

15. The air conditioner according to claim 14, wherein the cooling bypass pipe is diverged from an inlet pipe connected to both the indoor heat exchanger and an inlet port of the compressor.

16. The air conditioner according to claim 14, wherein the injection module further includes an injection pipe for interconnecting the injection heat exchanger and the compressor, the first injection expansion valve being located in the injection pipe.

17. The air conditioner according to claim 14, wherein the injection module further includes a heating bypass pipe for diverting the portion of the refrigerant, which moves from the indoor heat exchanger to the outdoor heat exchanger, the second injection expansion valve being located in the heating bypass pipe.

18. The air conditioner according to claim 17, wherein one end of the heating bypass pipe is connected to a pipe provided for interconnecting the indoor heat exchanger and the outdoor heat exchanger, and a remaining end of the heating bypass pipe is connected to the injection heat exchanger.

19. The air conditioner according to claim 17, wherein one end of the cooling bypass pipe is connected to an inlet pipe connected to both the indoor heat exchanger and an inlet port of the compressor, and a remaining end of the cooling bypass pipe is connected to the heating bypass pipe.

20. The air conditioner according to claim 15, further comprising a gas-liquid separator located in the inlet pipe, wherein the cooling bypass pipe diverts a portion of refrigerant introduced from the switching valve to the gas-liquid separator.

* * * * *